US007536124B2

(12) United States Patent
Yoshimoto

(10) Patent No.: US 7,536,124 B2
(45) Date of Patent: May 19, 2009

(54) IMAGE HEATING APPARATUS WITH DETECTION OF AN ABNORMAL STATE OF HEATER ELEMENT GROUPS

(75) Inventor: Tetsuhiro Yoshimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/943,294

(22) Filed: Nov. 20, 2007

(65) Prior Publication Data

US 2008/0124098 A1 May 29, 2008

(30) Foreign Application Priority Data

Nov. 27, 2006 (JP) ..... 2006-318513

(51) Int. Cl.

| | |
|---|---|
| ***G03G 15/20*** | (2006.01) |
| ***H05B 1/00*** | (2006.01) |
| ***H05B 3/00*** | (2006.01) |
| ***H05B 11/00*** | (2006.01) |

(52) U.S. Cl. ..... 399/33; 399/334; 219/216; 219/469

(58) Field of Classification Search ..... 399/33, 399/334, 320; 219/216, 469–471
See application file for complete search history.

(56) References Cited

U.S. PATENT DOCUMENTS

2005/0258158 A1 * 11/2005 Takami et al. ..... 219/216
2007/0237536 A1 * 10/2007 Roof et al. ..... 399/69

FOREIGN PATENT DOCUMENTS

JP 5-226063 9/1993

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

An image heating apparatus includes a plurality of heater element groups each having a plurality of heater elements. The heater elements are arranged along a direction intersecting an advancing direction of a recording material, and generate heat upon energization to heat a toner image on the recording material. A detecting mechanism is provided for detecting an abnormal state of the heater groups.

6 Claims, 11 Drawing Sheets

IMAGE HEATING APPARATUS WITH DETECTION OF AN ABNORMAL STATE OF HEATER ELEMENT GROUPS

BACKGROUND OF THE INVENTION

1. Field of the Invention

The present invention relates to an image heating apparatus for heating a toner image on a recording material. Examples of the image heating apparatus are a fixing device for heating and fixing a non-fixed toner image on the recording material, and a glossiness enhancing device for heating the fixed toner image on the recording material to enhance glossiness of the image.

2. Description of the Related Art

Conventionally, an image fixing device disclosed in Japanese Utility Model Application Publication No. 64-6514 is known as an image heating apparatus for heating a toner image on a recording material such as a paper sheet in an image forming apparatus such as a printer. In the image fixing device, a heating roll in which a pair of sheet positive character thermistor elements (heater elements) is integrally incorporated in a cylindrical rotation roll is used as a heat source. Therefore, according to the image fixing device, when a recording material on which a toner image is transferred passes between the heating roll and a pressure roller which is in contact with the heating roller under pressure, the recording material is heated and pressurized, and the toner image is fixed.

As an image heating apparatus using a sheet-like heater (heater element) as a heat source, there is one disclosed in Japanese Patent Application Laid-open No. 5-226063. According to the technique disclosed in the Japanese Patent Application Laid-open No. 5-226063, in order to prevent one sheet-like heater from being locally excessively heated, the sheet-like heater is divided into six heaters, the six heaters are divided into two group every other one, and the two groups are alternately ON/OFF controlled.

If the image heating apparatus uses the many heaters as the heat sources, there is a possibility that abnormal states are encountered in the respective heaters. Hence, in the image heating apparatus using the many heaters as the heat sources, it can be conceived to detect an abnormal state utilizing a variation in temperature of the entire heaters.

Japanese Patent Application Publication No. 6-89901 discloses a technique for displaying abnormal states of respective heaters incorporated in an electric carpet. According to the technique disclosed in the Japanese Patent Application Publication No. 6-89901, thermal wires are provided in adjacent to three heaters having different heating regions, a temperature signal circuit and a thermal wire abnormality detecting circuit are connected to each thermal wire. Relay contacts are provided between the three heaters and power supply, and a relay abnormality detecting circuit is connected to each relay contact. If an abnormal state is detected from the temperature signal circuit, the thermal wire abnormality detecting circuit or the relay abnormality detecting circuit, each heater displays which portion of the corresponding heating regions (left surface, central surface and right surface) has the abnormal state.

In the case of the structure for detecting an abnormal state using the variation in temperature of all of many heaters, if one heater out of n heaters gets out of order, a variation amount of detection output caused by this trouble is 1/n. That is, as the number of heaters is increased, the variation amount of detection output caused by the abnormality is reduced, and it is difficult to secure a sufficient S/N ratio enough to detect abnormality. Thus, it is difficult to detect that a trouble is negated in a specific heater from the temperature variation of all of the many heaters.

According to the Japanese Patent Application Publication No. 6-89901, since the temperature detecting thermal wire is disposed in each of the heaters, it is easy to detect that a trouble is generated in particular one heater out of the many heaters, but there is a problem that the structure becomes complicated and the cost is increased.

SUMMARY OF THE INVENTION

The present invention provides an image heating apparatus capable of inexpensively and appropriately detecting abnormality of a heating means having many heater elements.

Other objects as of the invention will become clear by reading the following detailed description with reference to the accompanying drawings.

To achieve the above object, an image heating apparatus of the present invention comprises: heating means having heater elements, arranged along a direction intersecting in an advancing direction of a recording material, for generating heat upon energization to heat a toner image on the recording material; and detecting means for detecting an abnormal state of the heating means; and the heating means includes a plurality of heater element groups each having a plurality of the heater elements, the detecting means includes a plurality of current detecting elements for detecting the abnormal state of the heater element groups respectively.

Further features of the present invention will become apparent from the following description of exemplary embodiments (with reference to the attached drawings).

DESCRIPTION OF THE EMBODIMENTS

Preferred embodiment of the present invention will be described in detail with reference to the drawings. However, sizes, material, shapes and relative positions of constituent parts described in the embodiments should appropriately be changed depending upon a structure of the apparatus to which the invention is applied and various conditions. Therefore, the scope of the invention is not limited to those only unless they are specifically defined.

Figure 1:
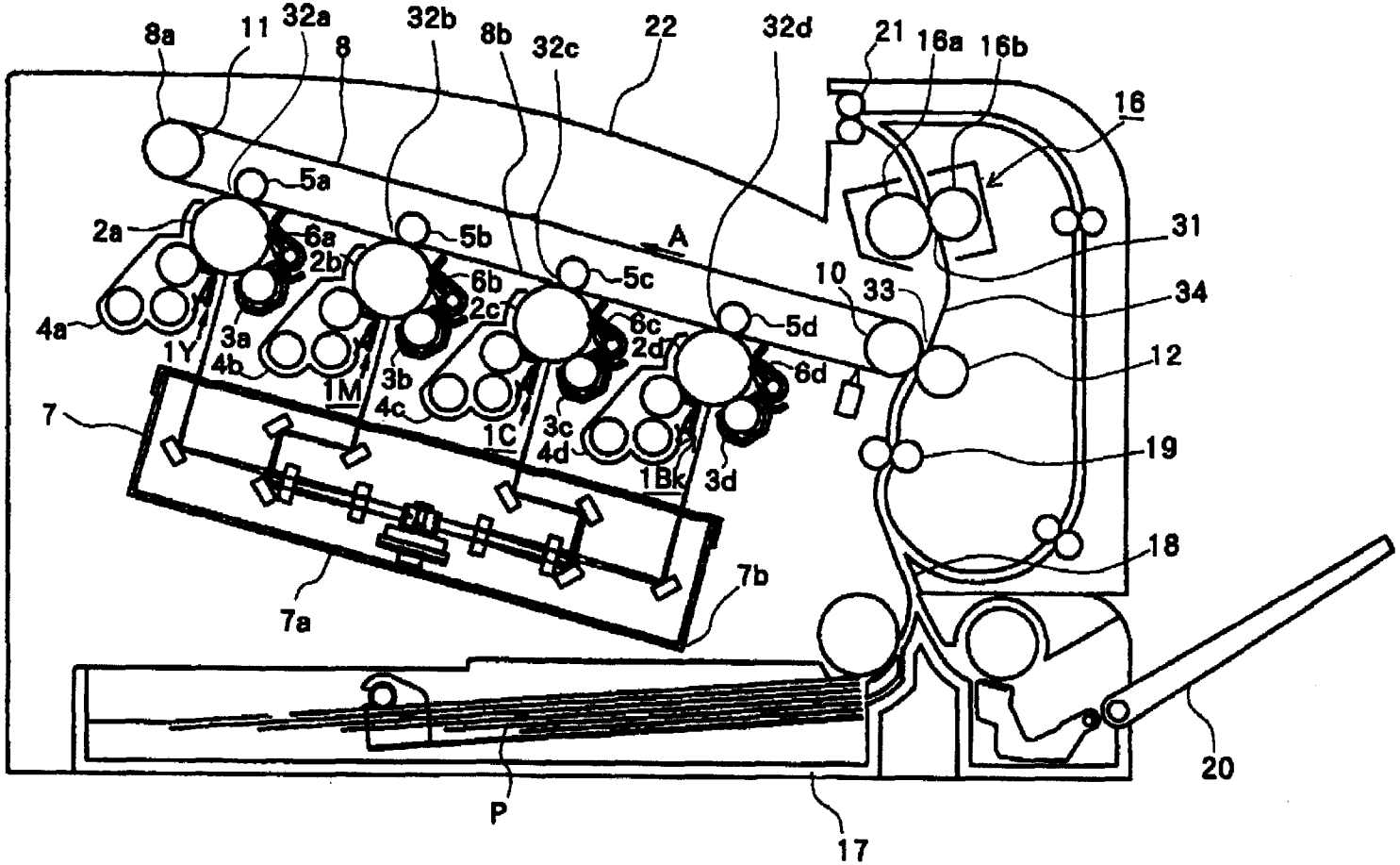
FIG. 1 is a schematic sectional view showing one example of an image forming apparatus.

FIG. 1 is a schematic sectional view showing one example of an image forming apparatus. An electrophotographic system tandem type color image forming apparatus (color printer) having an intermediate transfer belt (intermediate transfer means) is shown as an example of the image forming apparatus.

The image forming apparatus includes a plurality of image forming portions (image forming units). That is, the image forming apparatus includes an image forming portion 1Y for forming a yellow image, an image forming portion 1M for forming a magenta image, an image forming portion 1C for forming a cyan image and an image forming portion 1Bk for forming a black image. These four image forming portions 1Y, 1M, 1C and 1Bk are disposed on one line at constant distances from one another. Supply units 17 and 20 are disposed below the image forming portions, and carrier guides 18 and 34 forming a carrier pass are vertically disposed below the image forming portions, and a fixing unit 16 is disposed above the image forming portions.

Next, each unit will be described in detail. In the image forming portions 1Y, 1M, 1C and 1Bk, drum electrophotographic photosensitive members (photosensitive drums, hereinafter) 2*a*, 2*b*, 2*c* and 2*d* are disposed as image bearing members. Primary chargers 3*a*, 3*b*, 3*c* and 3*d*, developing devices 4*a*, 4*b*, 4*c* and 4*d*, transfer rollers 5*a*, 5*b*, 5*c* and 5*d* as transfer means, and drum cleaners 6*a*, 6*b*, 6*c* and 6*d* are disposed around the photosensitive drums 2*a*, 2*b*, 2*c* and 2*d*, respectively. A laser exposing device 7 is disposed below a space between the primary chargers 3*a*, 3*b*, 3*c* and 3*d* and the developing devices 4*a*, 4*b*, 4*c* and 4*d*.

Each of the photosensitive drums 2*a*, 2*b*, 2*c* and 2*d* includes a photoconductive layer on an aluminum drum base body which is a negatively charged OPC photosensitive member. The photosensitive drums 2*a*, 2*b*, 2*c* and 2*d* are rotated at a predetermined process speed in a direction of the arrow (counterclockwise direction) by a drive device (not shown).

The primary chargers 3*a*, 3*b*, 3*c* and 3*d* as the primary charging means uniformly charge surfaces of the photosensitive drums 2*a*, 2*b*, 2*c* and 2*d* with predetermined negative potential by charging bias applied from a charging bias power supply (not shown).

The laser exposing device 7 disposed below the photosensitive drum includes laser emitting means for emitting light corresponding to a tire series electric digital picture element signal of applied image information, a polygonal lens, and a reflection mirror. The laser exposing device 7 exposes the photosensitive drums 2*a*, 2*b*, 2*c* and 2*d* to light, thereby forming electrostatic latent images in accordance with image information on surfaces of the photosensitive drums 2*a*, 2*b*, 2*c* and 2*d* charged by the primary chargers 3*a*, 3*b*, 3*c* and 3*d*.

Yellow toner, cyan toner, magenta toner and black toner are respectively accommodated in the developing devices 4*a*, 4*b*, 4*c* and 4*d*. The developing devices 4*a*, 4*b*, 4*c* and 4*d* adhere toner of respective colors to electrostatic latent images formed on the photosensitive drums 2*a*, 2*b*, 2*c* and 2*d*, thereby developing toner images (making the images visible).

The transfer rollers 5*a*, 5*b*, 5*c* and 5*d* as primary transfer means are disposed such that they can abut against the photosensitive drums 2*a*, 2*b*, 2*c* and 2*d* through an intermediate transfer belt 8 at the primary transfer portions 32*a*, 32*b*, 32*c* and 32*d*. The transfer rollers 5*a*, 5*b*, 5*c* and 5*d* transfer and superpose toner images on the photosensitive drums onto the intermediate transfer belt 8 by the primary transfer portions 32*a*, 32*b*, 32*c* and 32*d*.

Each of the drum cleaners 6*a*, 6*b*, 6*c* and 6*d* comprises a cleaning blade or the like, they scrape off residual toner which remains on the photosensitive drum 2 at the time of the primary transfer operation from the photosensitive drum 2 to clean the surface of the drum.

The intermediate transfer belt 8 is disposed on the side of an upper surfaces of the photosensitive drums 2*a*, 2*b*, 2*c* and 2*d*, and is stretched between the secondary transfer counter roller 10 and the tension roller 11. The secondary transfer counter roller 10 is disposed such that it can abut against the secondary transfer roller 12 through the intermediate transfer belt 8 in the secondary transfer portion 33. The intermediate transfer belt 8 is made of dielectric resin such as polycarbonate, polyethylene terephthalate resin film and polyvinylidene fluoride resin film. In the secondary transfer portion 33, an image transferred on the intermediate transfer belt 8 is transferred onto a recording material P which is carried from a supply unit 17. A belt cleaner (not shown) is disposed outside the intermediate transfer belt 8 and near the tension roller 11. The belt cleaner removes and collects residual toner remaining on the surface of the intermediate transfer belt 8.

Images are formed by the toner in accordance with the above process.

The supply unit 17 includes a cassette in which the recording materials P are accommodated, a paper feed roller and a separation pad for sending out the recording materials P from the cassette one sheet by one sheet. The supply unit 20 includes a manual feeding tray on which the recording materials P are placed, and a paper feed roller and a separation pad for sending the recording materials P from the manual feeding tray one sheet by one sheet. The supplied recording material is sent to a registration roller 19 along the carrier guide 18. The registration roller 19 sends out a recording material P to a secondary transfer region with the image forming timing.

The fixing units 16 are arranged in many rows in the widthwise direction intersecting with an advancing direction of the recording material, and include positive character thermistor elements (heater elements) as heating means which generate heat upon energization. These positive character thermistor elements are disposed on a ceramic substrate disposed in a direction intersecting with the advancing direction of the recording material. These positive character thermistor elements have such characteristics that heat generating abilities substantially disappear if the temperature reaches a set value even if current is supplied. In the following explanation, the heater element is called a heater or a heater element. The fixing unit 16 includes a fixing film 16*a* as a fixing member (heating rotary body), and a pressure roller 16*b* as a pressure member (nip forming member) which is pressurized by the substrate through the fixing film 16*a*. In this example, the pressure roller does not have the heat source, but the pressure roller may have the heat source. A carrier guide 34 is provided for introducing the recording material P to a nip portion 31 of the pair of roller upstream of the fixing unit 16. A discharge roller 21 for leading the recording material P discharged from the fixing unit 16 out from the apparatus is disposed downstream of the fixing unit 16.

The control unit includes a control substrate for controlling motion of a mechanism in each unit, and a motor driver substrate (not shown).

Figure 2:
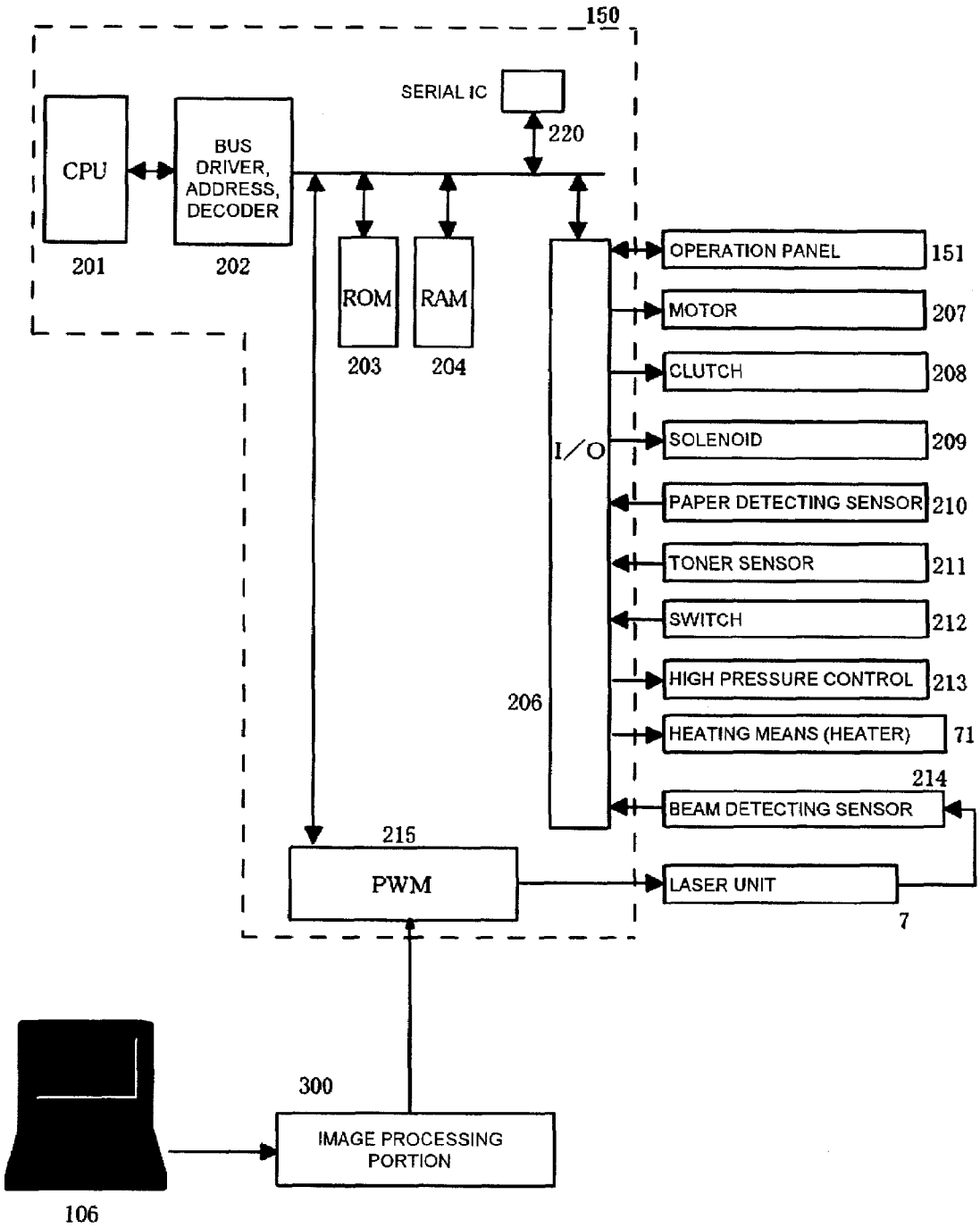
FIG. 2 is a block diagram of electrical components in the image forming apparatus.

FIG. 2 is a block diagram of a controller 150 and an image processing portion 300 in the image forming apparatus.

A CPU (controller) 201 is a control means for controlling the entire image processing apparatus. The CPU sequentially reads programs from a ROM 203 which stores control procedure (control program) of an apparatus main body, and executes the programs. An address bus and a data bus of the CPU 201 are connected to each load through a bus driver circuit and an address decoder circuit. A RAM 204 is a main memory used for storing input data and used as an operation storing region. A serial IC 220 establishes communication with peripheral circuits, and is used when an expansion device is connected.

An I/O interface 206 is connected to an operation panel 151 in which an operator inputs using keys and a state of the apparatus is displayed using a liquid crystal or LEDs, a supply system, a carrier, a motor 207 which drives an optical system, a clutch 208 and a solenoid 209. The I/O interface is also connected to each load of an apparatus such as a paper detecting sensor 210 for detecting a carried recording material. A remaining toner sensor 211 for detecting a toner amount in a developing device is disposed in the developing device 4, and its output signal is input to the I/O interface 206. Further, a signal of the switch 212 for detecting a home position of each load and an opening/closing state of a door is also input to the I/O interface 206. A high pressure unit 213 outputs a high pressure to the primary charger 3, the developing device 4 and the transfer roller 5. A heating means 71 is formed by base materials which are arranged in many rows in a widthwise direction intersecting with the advancing direction of the recording material, and AC voltage is supplied to the heating means by an ON/OFF signal.

An image processing portion 300 also includes a CPU, and is connected to the CPU 201 through a serial signal. The image processing portion establishes communication, and sends and receives output timing to and from the engine portion. If an image signal which is output from a connected personal computer 106, image processing is carried out, and image data is output to the engine portion. A PWM control circuit 215 is driven in accordance with image data from the image processing portion 300, a photosensitive drum 2 is irradiated with and exposed to laser beam which is output from the laser unit (laser exposing device) 7 based on the produced controlled waveform. A light emitting state is detected by a beam detection sensor 214 which is a light receiving sensor in a non-image region, and its output signal is input to the I/O interface 206.

The image forming operation of the engine portion of the color image forming apparatus will be described next.

If an image forming start signal is sent from a personal computer connected to the image forming apparatus, the paper feeding operation is started from the selected cassette or manual feeding tray. A case in which paper is fed from the cassette will be described. First, recording materials P are sent out from the cassette by the paper feed roller one sheet by one sheet. The recording material P is guided between the carrier guides 18 and carried to the registration roller 19. At that time, the registration roller 19 is stopped and a tip end of the recording material abuts against the nip portion. Then, the registration roller 19 starts rotating based on a timing signal at which the image forming portion starts forming the image. This rotation timing is set such that the recording material P and a toner image which is primary transferred onto the intermediate transfer belt 8 by the image forming portion match with each other in the secondary transfer region.

In the image forming portion, if an image forming start signal is sent, an electrostatic latent image is formed on the photosensitive drum of each color. An image forming timing in a sub-scanning direction is determined and controlled in accordance with a distance between image forming portions from the most upstream photosensitive drum 2*a* in the rotation direction of the intermediate transfer belt 8. A writing timing in a main scanning direction of each drum is controlled by producing a pseudo BD SENSOR signal using one BD SENSOR signal (here, it is disposed on an image forming portion Bk) by a circuit operation (not shown). The formed electrostatic latent image is developed by the above-described process. The toner image formed on the most upstream photosensitive drum 2*a* is primary transferred to the intermediate transfer belt 8 in the primary transfer region 32*a* by the primary transfer roller 5*a* to which high voltage is applied. The primary transferred toner image is carried to the primary transfer region 32*b*. Here, an image is formed at a timing delayed by time during which the toner image is carried between the image forming portions by the timing signal, and a next toner image is transferred such that registrations are aligned on the former image. Thereafter, the same step is repeated, and toner images of four colors are primary transferred on the intermediate transfer belt 8.

Then, if the recording material P enters the secondary transfer portion 33 and comes into contact with the intermediate transfer belt 8, high voltage is applied to the secondary transfer roller 12 at the passing timing of the recording material P. The four color toner images formed on the intermediate transfer belt 8 by the above-described process are secondary transferred onto the recording material P. After the secondary transfer, the recording material P is precisely guided to nip portions of a pair of fixing rollers 16*a* and 16*b* by the carrier guide 34. The toner image is fixed onto a surface of a recording material P by heat of the fixing film 16*a* and the pressure roller 16*b* and a pressure of the nips. A structure of the fixing unit 16 and the temperature control will be described later. Thereafter, the recording material P is carried by the discharge roller 21, and is discharged out from the apparatus and the series of image forming operation is completed.

Although the image forming portions having different colors are disposed from the upstream in the order of yellow, magenta, cyan and black in this embodiment, this order is determined by characteristics of the apparatus and the invention is not limited to this order.

Figure 3:
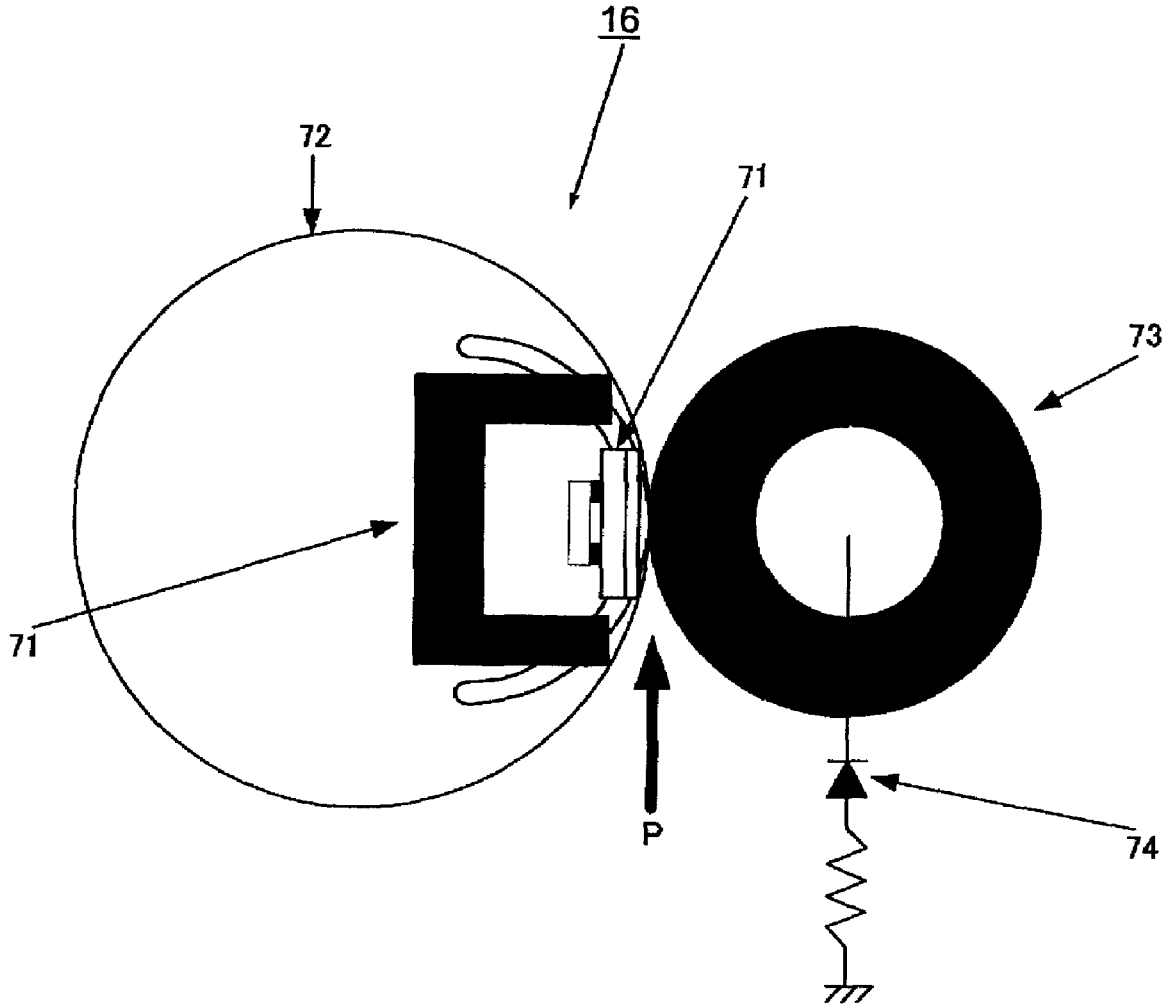
FIG. 3 is a schematic sectional view showing one example of a fixing unit.

Next, a structure of the fixing unit 16 as a heating device will be described. FIG. 3 is a schematic sectional view showing the fixing unit 16 shown in FIG. 1.

In FIG. 3, there are shown a heating means 71, a fixing film 72, a pressure roller 73 and a self-bias circuit 74. The heating means 71 has a large number of heaters disposed on a base material having high thermal conductivity. The fixing film 72 is made of metal as a base material, and is coated with a rubber layer of about 300 μm and is subjected to fluorine surface processing. The fixing film 72 has extremely small thermal capacity, and transmits heat of the heating means 71 only to the nip portion. The pressure roller 73 has hardness of about 60°, and frictionally drives the fixing film 72. A U-shaped sheet metal 75 pressurizes the fixing film 72 against the pressure roller 73 from inside, and the pressure is about 180 N.

Figure 4:
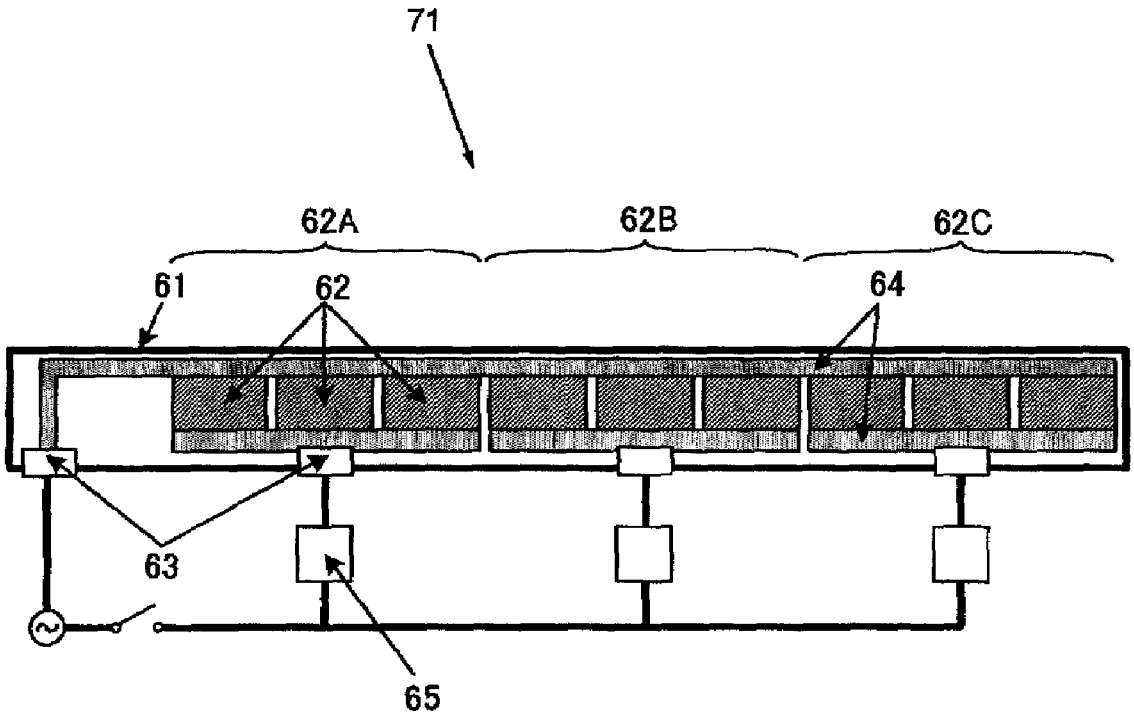
FIG. 4 is a diagram showing a structure of heating means using current detection.
Figure 5:
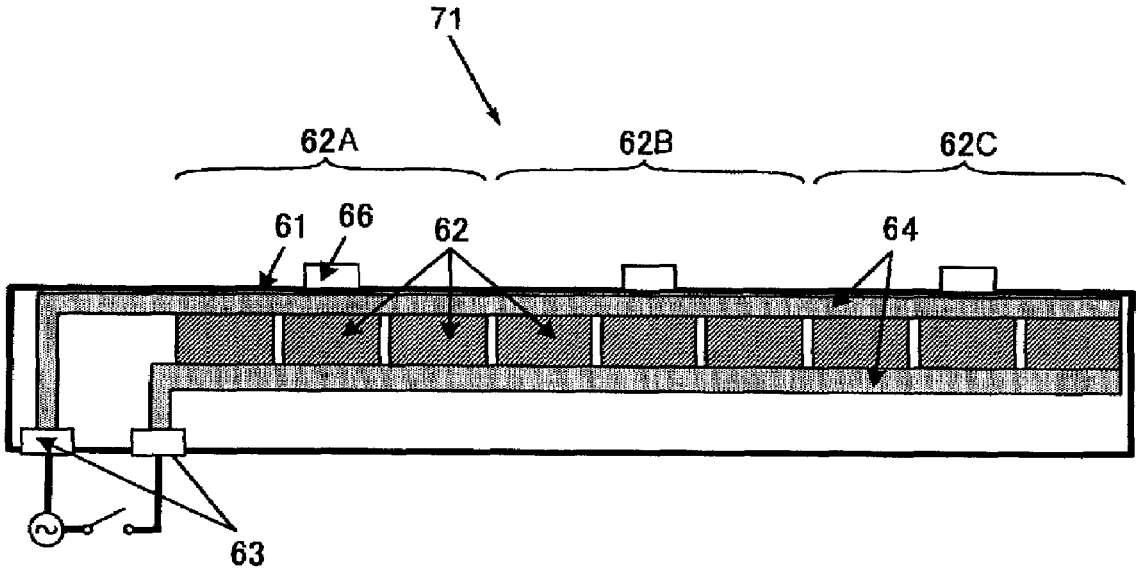
FIG. 5 is a diagram showing a structure of heating means using temperature detection.

A system for detecting a trouble of the fixing unit 16 will be described using FIGS. 4 and 5. FIGS. 4 and 5 are plan views of the heating means 71.

As shown in FIGS. 4 and 5, in the heating means 71, many heaters 62 (nine, in this embodiment) are disposed on a conductor 64 which is a base material having high thermal conductivity. The many heaters 62 comprises a plurality of (three, in this embodiment) heater groups 62A, 62B and 62C (each group including a given number (three, in this embodiment) heaters. The heating means 71 also includes an electrode 63. If voltage is applied to both ends of the heaters 62, it generates heat.

The fixing unit 16 includes detecting means for detecting an abnormal state of the heating means 71. This detecting means includes a current detecting element which is commonly used by heaters in each heater group for detecting the abnormal state. In FIG. 4, a current detecting circuit 65 as the current detecting element is provided in each of the heater groups 62A, 62B and 62C, and the current detecting circuit 65 detects a current value of the heater groups 62A, 62B and 62C. The current detecting circuit 65 and the heaters 62 are electrically connected to each other through the electrode 63. On the other hand, in FIG. 5, a temperature detecting circuit 66 is used as the current detecting element, and the temperature detecting circuit 66 detects a current value of each of the heater groups 62A, 62B and 62C. The detecting means includes many temperature detecting elements (e.g., thermistors) provided such as to correspond to the heaters 62, and the temperature detecting circuit 66 is provided in each temperature detecting element group, i.e., heater group comprising the plurality of temperature detecting elements. A controller (CPU) including a later-described trouble detecting circuit determines abnormality of each of the heater groups 62A, 62B and 62C based on information from the detecting means.

Figure 6:
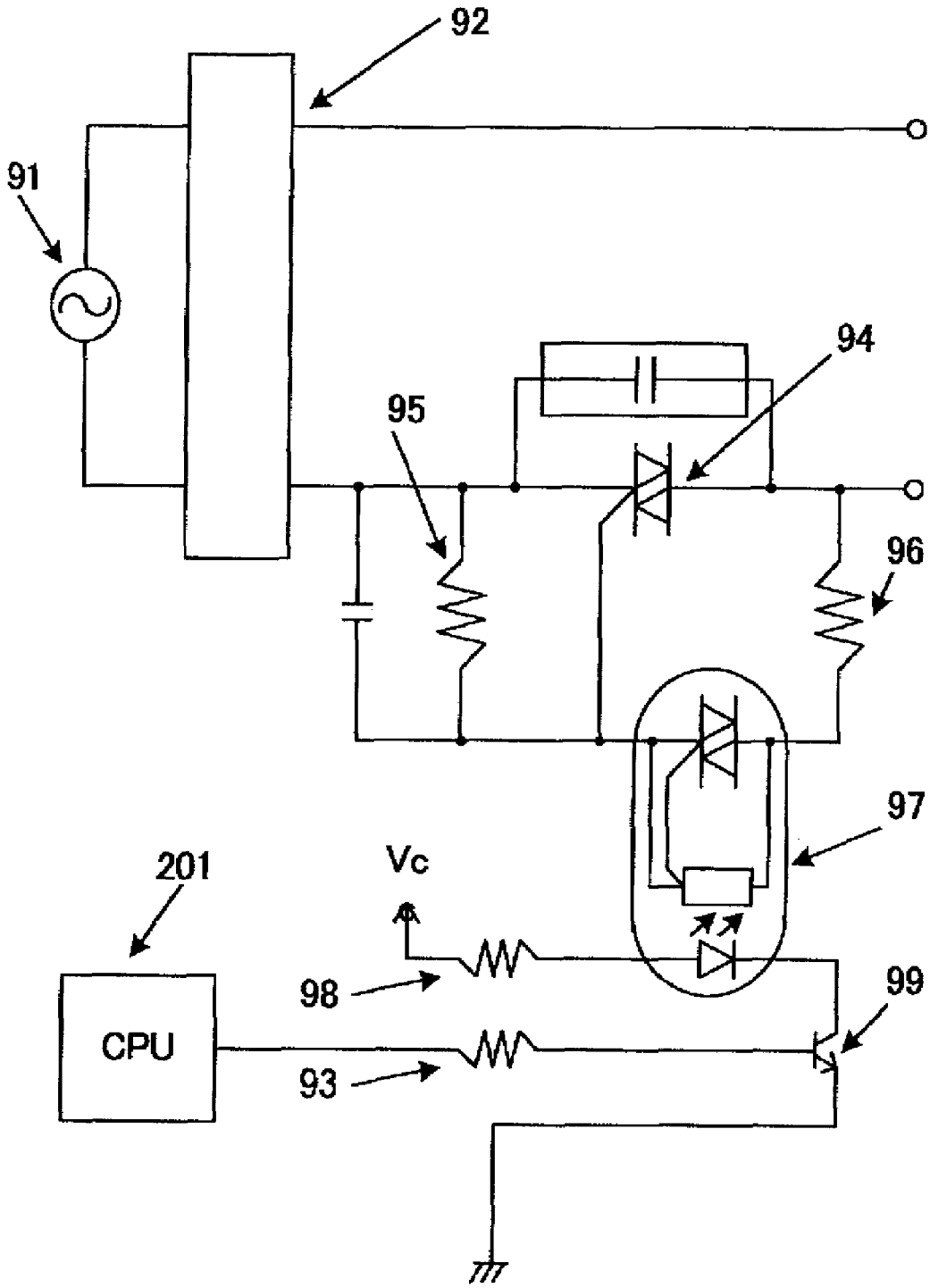
FIG. 6 is a diagram of a heater drive control circuit.
Figure 7:
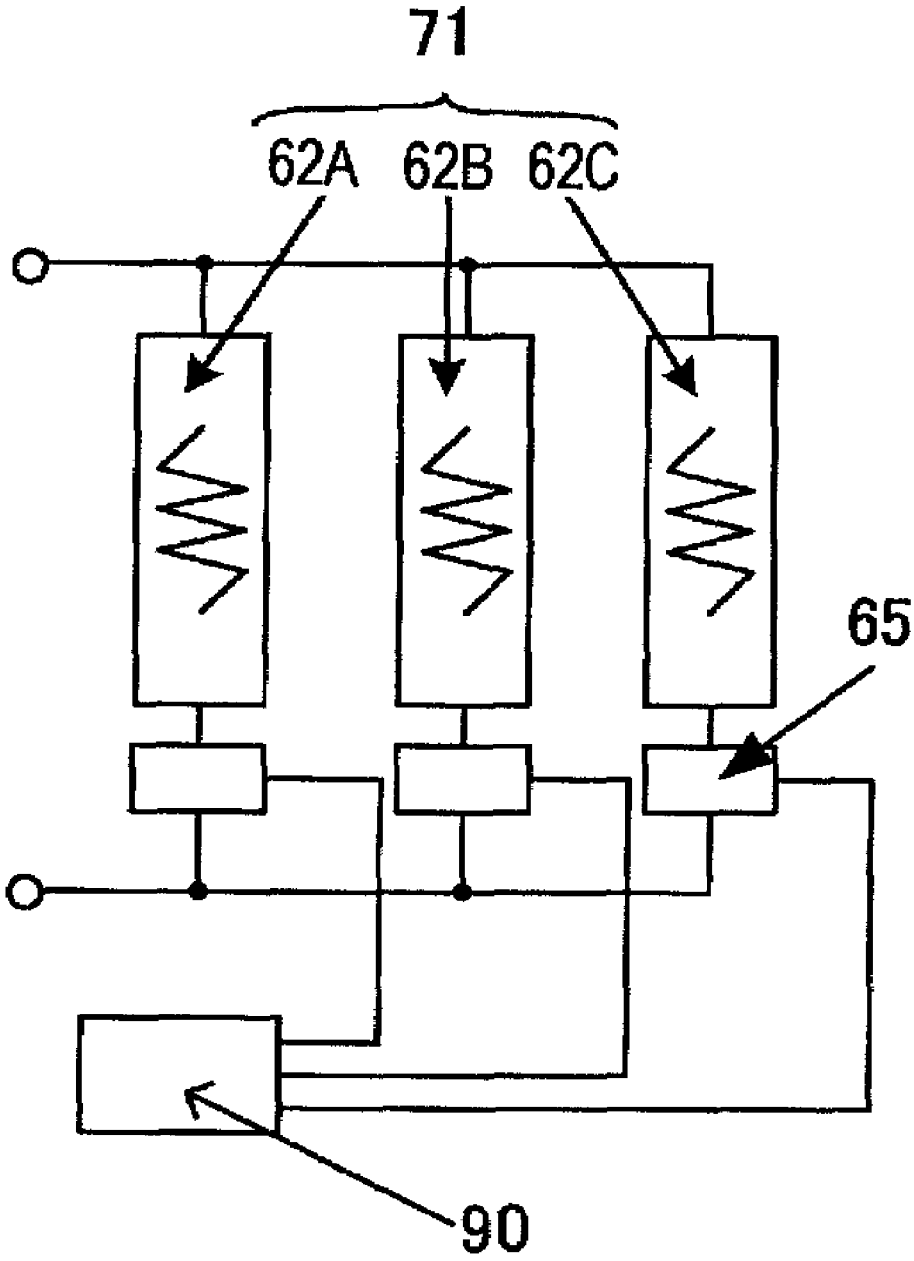
FIG. 7 is a diagram of a heater circuit which is connected to the heater drive control circuit and which uses current detection.
Figure 8:
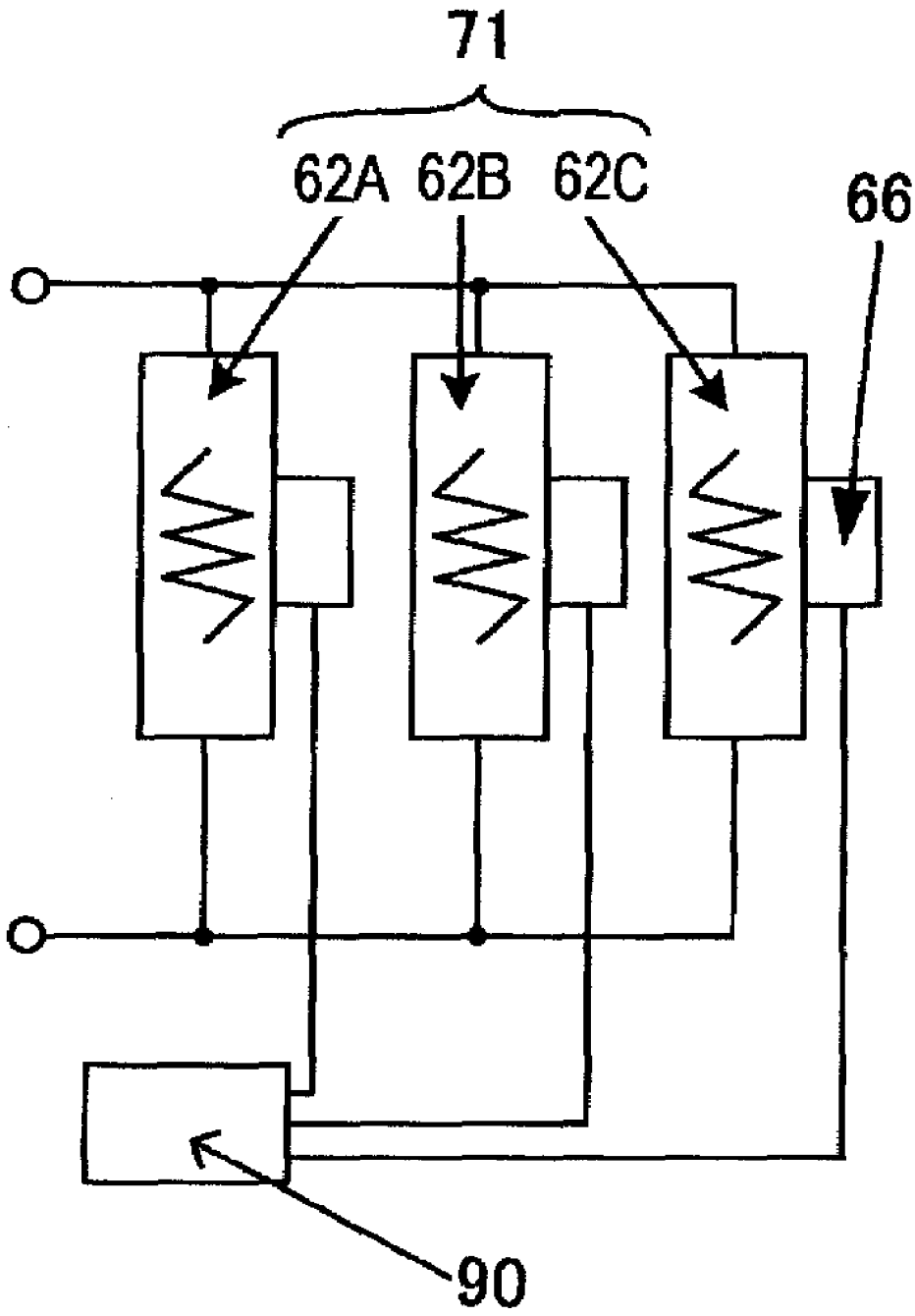
FIG. 8 is a diagram of a heater circuit which is connected to the heater drive control circuit and which uses temperature detection.

Next, a circuit for detecting a trouble of the heating means 71 in the fixing unit 16 will be described. FIG. 6 is a circuit diagram showing a circuit configuration of a heater drive control circuit which drives and controls the heating means 71. FIGS. 7 and 8 are circuit diagrams showing a circuit configuration of a heater circuit having the heating means.

If a heater circuit shown in FIG. 7 or 8 is connected to the heater drive control circuit, the heating means 71 in the fixing unit 16 is driven. The heater circuit shown in FIG. 7 includes heating means 71 having a plurality of heater groups 62A, 62B and 62C comprising a plurality of heaters. Each of the heater groups 62A, 62B and 62C is provided with a current detecting circuit 65 as a current detecting element. These current detecting circuits 65 are connected to a trouble detecting circuit 90 as abnormality determining means. The heater circuit shown in FIG. 8 includes heating means 71 having a plurality of heater groups 62A, 62B and 62C comprising a plurality of heaters. Each of the heater groups 62A, 62B and 62C is provided with a temperature detecting circuit 66 as a current detecting element. These temperature detecting circuits 66 are connected to a trouble detecting circuit 90 as abnormality determining means.

As shown in FIG. 6, the heater drive control circuit includes an AC power supply 91 which supplies electricity to the entire printer. The heating means 71 is connected to the AC power supply 91 through an AC filter 92. The trouble detecting circuit 90 is connected between the AC filter 92 and the heating means 71. The heater drive circuit includes a triac 94, registers 95 and 96, a photo triac coupler 97 which is serially connected between the registers 95 and 96, and a register 98 having one end connected to the photo triac coupler 97. The heater drive circuit also includes a transistor 99 whose collector terminal is connected to the photo triac coupler 97, a register 93 connected to a base terminal of the transistor 99, and a CPU 201 connected to one end of the register 93 and to which an informing signal from the trouble detecting circuit 90 is connected.

If electricity is supplied to the heating means 71 through the AC filter 92, the AC power supply 91 such as utility power supply allows the heating means 71 to generate heat. Electricity supply to the heating means 71 is energized or cut off by the triac 94. The registers 95 and 96 are bias registers for the triac 94. The photo triac coupler 97 is a device for securing a creeping distance between primary and secondary. If the light-emitting diode of the photo triac coupler 97 is energized, the triac 94 is turned ON. The register 98 is for limiting current of the photo triac coupler 97, and is turned ON/OFF by the transistor 99. The transistor 99 is operated in accordance with an ON signal from the CPU 201 through the register 93.

When the heater circuit shown in FIG. 7 is to be connected, current values to the heater groups 62A, 62B and 62C of the heating means 71 are detected by the current detecting circuits 65 provided in the respective heater groups. The current detecting circuit 65 informs the trouble detecting circuit 93 of the current values. When the trouble detecting circuit determines that there is abnormality in a value informed by the current detecting circuit 65, the trouble detecting circuit informs the CPU 201 that a trouble is detected. The CPU 201 which received the abnormality informing signal displays, on the operation panel 151, the heater group of the heating means 71 which generated the trouble, cuts off energization to the heating means 71 and safely stops the apparatus. The energization OFF to the heating means is carried out by turning the transistor 99 OFF to limit current of the photo triac coupler 97 and to cut off current by the triac 94.

When the heater circuit shown in FIG. 8 is connected, current values to the heater groups 62A, 62B and 62C of the heating means are detected by the temperature detecting circuits 66 provided in the heater groups (temperature detecting elements). A register value of the temperature thermistor provided in correspondence with the heater is changed in accordance with the temperature of the heater 62. At that time, values of currents flowing through temperature thermistors of the heater groups (three groups) are detected by trouble detecting circuits (current detecting element) 65 provided in the heater groups (temperature thermistor groups). The temperature detecting circuit 65 informs the trouble detecting circuit 90 of the detected current value. When the trouble detecting circuit 90 determines that there is abnormality in a value informed by the temperature detecting circuit 66, the trouble detecting circuit 90 informs the CPU 201 that a trouble is detected. The CPU 201 which received the trouble informing signal displays, on the operation panel 151, a heater group of the heating means 71 which generated the trouble, and cuts of energization to the heating means 71 and safely stops the apparatus.

In the heater circuit shown in FIG. 7, a current detecting register is used as the current detecting circuit 65, and a current value is detected. The current detecting circuit 66 is informed of the detected value, and when the trouble detecting circuit 90 determines that there is abnormality in at least one of values informed from the current detecting circuits 66, the trouble detecting circuit 90 informs the CPU 201 that the trouble is detected. The CPU 201 which received the trouble informing signal sends a signal for informing an operator that the heating means 71 (or fixing unit) has a trouble. More specifically, one of heater group of the heating means 71 which generated the trouble is displayed on the operation panel 151 as the operating portion, and stops the energization to the heating means 71. With this, the heating means 71 (fixing unit) can safely be stopped. As the energization is stopped, the entire apparatus (other image forming devices) are also stopped safely.

When the image forming apparatus includes a printer function for forming an image by a print signal received from a personal computer (PC, hereinafter) which is an external device, the CPU 201 sends a signal for informing that the heating means 71 is in the abnormal state to the PC. This signal may be sent to the PC through a LAN cable, or may be sent through radio. If the image forming apparatus includes the controller (CPU) for sending a signal for informing that the heating means 71 is in trouble, it is possible to inform various external devices of the abnormality.

The method for using the current detecting register as the current detecting circuit is shown as an example, and the invention is not limited to this.

Figure 9:
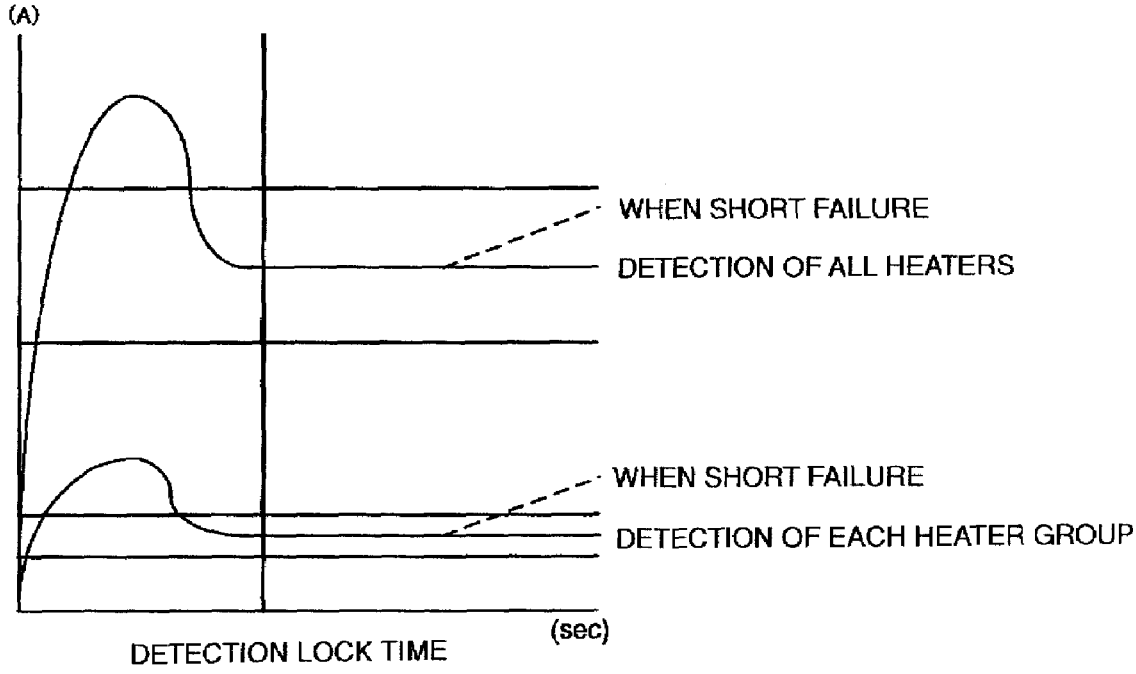
FIG. 9 is a diagram showing a detection state of trouble caused by a current value of a heater group.
Figure 11:
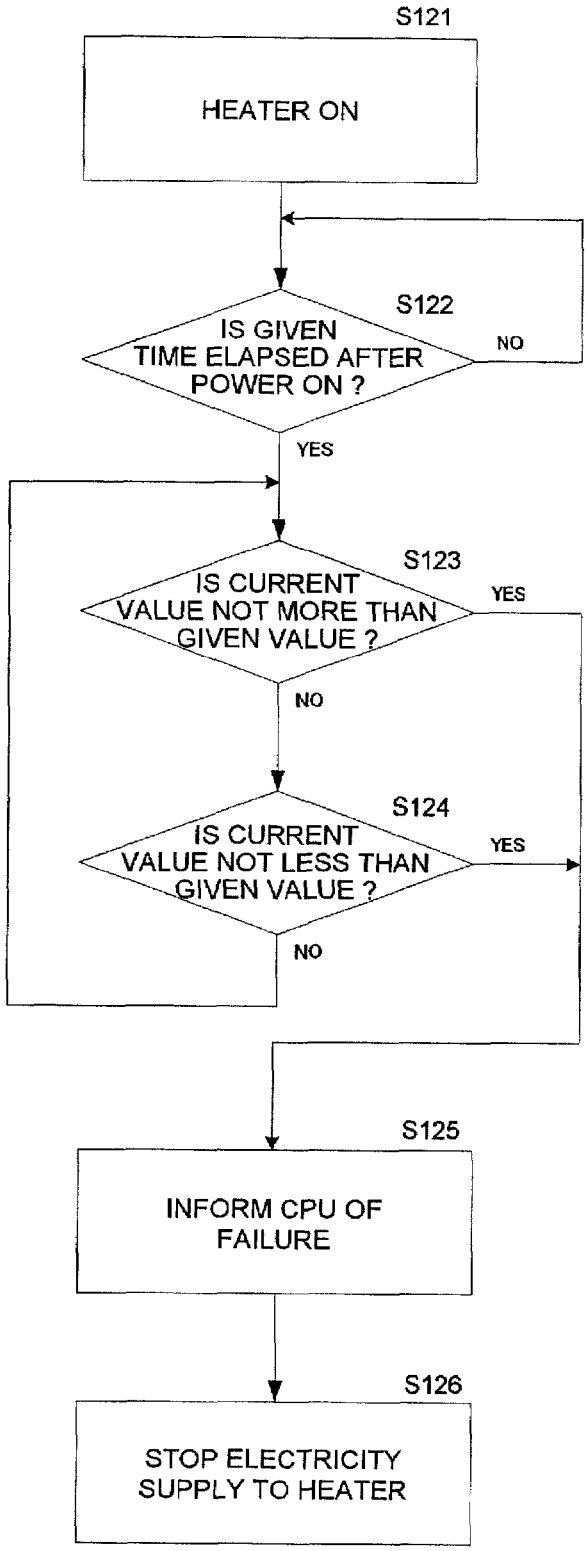
FIG. 11 is a flowchart showing a flow of a trouble detection of the heater group.

Next, a trouble detecting operation using a current detecting circuit will be described using FIGS. 9 and 11. FIG. 9 shows a detecting state of a trouble by a current value, a vertical axis shows a current value (A) and a horizontal axis shows time (sec). FIG. 11 is a flowchart showing a flow of trouble detection of each heater group.

If the heating operation of the heating means 71 (energization to the heating means) is started (step S121), large current flows by inrush current, but after certain time is elapsed, the current is converged into a constant current value. This state transition time is defined as detection lock time, and detection of current value is started after constant time is elapsed (step S122). It is determined whether a current value of each heater group detected by each current detecting circuit is equal to or greater than a present value or equal to or less than the present value. When each current value of each heater group is equal to or higher than a constant value (a prescribed value), it is determined that the heater is in a trouble caused by a short mode (step S123). On the other hand, when the current value of the heater group is equal to or lower than the constant value, it is determined that the trouble is caused by an open mode (step S124). When it is determined that the heater is in a trouble, a trouble informing signal is sent to the CPU (step S125). Then, electricity supply to the heating means 71 is stopped (step S126). Here, the short mode trouble is a trouble state in which a register value of the heater element is held in the high register value state, and the open mode trouble is a trouble state in which a low register value state is held.

Although the current is not detected during a period until constant time is elapsed after the start of energization to the heating means in the above example, current detection may be carried out during this period (within set time) but the detected current is regarded as invalid output and control may be performed. That is, the CPU (trouble detecting circuit) ignores the output signal irrespective of a current value detected by the current detecting circuit during the period.

The heating means comprising many heaters are divided into heater groups each having a given number of heaters, and current detection is carried out in each of the heater group. An effect of this structure will be described using concrete numbers. A current value of one heater out of heaters constituting the heating means 71 is defined as 1 A, and if 2 A or higher current flows through one heater, this is determined as a trouble.

When a case in which 20% or higher abnormal value is seen in a total current value of all of the heater (nine, in this example) is defined as a trouble, if the trouble caused by the short mode or the open mode is seen in one element, the abnormal value will be 1/9 at the time of full currents. In the case of this example in which a trouble is detected in each heater group, it will be 1/3 , and is a value satisfying abnormal value of 20%.

At that time, a S/N ratio is 20 $\log_{10}$ 1/9 at the time of full current, and in the case of this example in which the trouble is detected in each heater group, the S/N ratio is 20 $\log_{10}$ 1/3 and thus, the precision of abnormality determination is superior in the present structure in which a trouble is detected in each heater group.

Here, the S/N ratio (Signal to Noise ratio) is a ratio of signal to noise expressed using a logarithm, this is also called SNR, and is used as a numeric value expressing quality of video, sound and communication line. A unit thereof is dB (decibel), and as the numeric value is greater, the noise is lower and higher quality signal can be obtained.

As described above, the heating means 71 comprising many heaters 62 is divided into heater groups each comprising the a given number of heaters, the current detecting means is provided in each heater group, and abnormality is determined in each heater group. In the case of a comparative example in which the current detecting means is provided in each heater element, abnormality can be detected with precision of the S/N ratio of 20 $\log_{10}$ 1, but this structure has excessive specs for the required S/N ratio, and this structure is expensive. That is, the cost of the structure can be reduced, and a heater group including a heater generating abnormality can be detected from the many heaters precisely.

In the above example, the trouble detecting circuit compares a current value of each heater group detected by each current detecting circuit and a present prescribed value with each other, thereby determining abnormality of the heater group. The structure for determining abnormality of the heater group by comparison is not limited to this. For example, the detected current value of a specific heater group may be compared with a detected current value of each heater group, and when the difference therebetween is equal to or greater than a preset prescribed value, it may be determined as abnormality. Alternatively, detected current values of heater groups located at symmetric positions with respect to the center of the plurality of heater groups arranged in parallel may be compared, and when the difference therebetween is equal to or greater than a constant value, it may be determined as abnormality. In this case, since the heater groups at the symmetric positions are compared with each other, it is preferable that the even number of heater groups are provided. With this structure also, the same effect as that of the above-described embodiment can be obtained.

Figure 10:
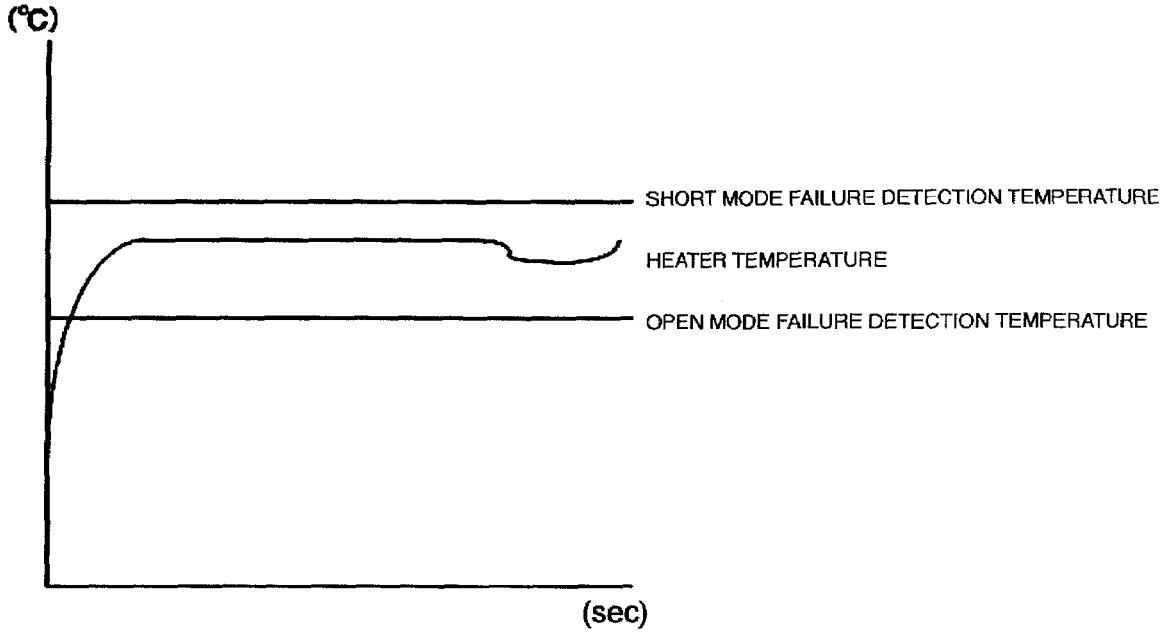
FIG. 10 is a diagram showing a detection state of trouble caused by a temperature of the heater group.

Next, a trouble detecting operation using a trouble detecting circuit will be described using FIG. 10. FIG. 10 shows a detection state of a trouble by temperature, a vertical axis shows temperature (° C.) and a horizontal axis shows time (sec). Although a flow of trouble detection of each heater group by the temperature is not illustrated, and the flow is the same as that of the trouble detection of each heater group by the current value described using FIG. 11.

If the heating operation of the heating means 71 is started, the heating temperature rises until the temperature of the heating means 71 reaches a certain value. This state transition time is defined as detection lock time, and detection of temperature is started after constant time is elapsed. A register value of the temperature thermistor (one for each element) disposed on a back side of a substrate of each heater element of all of the heaters (nine, in this example) constituting the heating means 71 is varied in accordance with the element temperature. At that time, a value of current flowing through the temperature thermistor of each heater group (three groups in this example) is detected by the trouble detecting circuit (current detecting element) provided in the heater group (temperature thermistor group). The processing and the circuit configuration thereafter are the same as those of the trouble detection flow of the heater group by the current value. When the thermistor current value of each heater group is equal to or higher than a constant value (prescribed value), it is determined that the heater is in trouble by the short mode. When the thermistor current value of each heater group is equal to or lower than the constant value, it is determined that the heater is in trouble by the open mode. When it is determined that the heater is in trouble, a trouble informing signal is sent to the CPU, and heating of the heating means 71 is stopped.

The method using the temperature thermistor as the trouble detecting circuit (temperature detecting element) is shows as an example only, and the present invention is not limited to this.

An effect obtained when the temperature of each heater is detected is not described while showing concrete numbers, but the same effect as that when the current value is detected can be obtained of course. That is, the temperature (current value) is detected by each trouble detecting circuit provided on each heater group (each temperature thermistor group) through the temperature thermistor provided in each heater, and as compared with a case where a temperature variation of all heaters is detected by one temperature detecting means, the S/N ratio of the detection is enhanced.

As described above, the heating means 71 comprising the many heaters 62 is divided into heater groups each comprising a given number of heaters, the detecting means is provided in each heater group, and the abnormality of each heater group is determined. With this, the cost of the structure is reduced, and it is possible to precisely detect a heater group including a heater which generates abnormality out from the many heaters.

In the above-described embodiment, the trouble detecting circuit compares the temperature of each heater group detected by each trouble detecting circuit and the preset prescribed value with each other, thereby determining the abnormality of the heater group, but the structure for determining the abnormality of the heater group by comparison is not limited to this. For example, a detected temperature of a specific heater group may be compared with a detected temperatures of all of other heater group, and when the difference therebetween is equal to or greater than a preset prescribed value, it may be determined that there is an abnormal state. Alternatively, detected temperatures of heater groups located at symmetric positions with respect to the center of the plurality of heater groups arranged side by side may be compared with each other, and when the difference therebetween is equal to or greater than a preset prescribed value, it may be determined that there is an abnormal state. In this case, since the heater groups located at the symmetric positions are compared with each other, it is necessary that the even number of heater groups are disposed. With this structure, the same effect as that described above can be obtained.

In the above-described embodiment, the example of the fixing device has been described, but the present invention can also be applied to apparatuses other than the fixing device. For example, the invention can also be applied to a glossiness enhancing device which enhances glossiness of an image by reheating a toner image which is fixed onto a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-318513, filed Nov. 27, 2006, which is hereby incorporated by reference herein in its entirety.

What is claimed is:

1. An image heating apparatus comprising:

a heating means having heater elements, arranged along a direction intersecting in an advancing direction of a recording material, for generating heat upon energization to heat a toner image on the recording material; and a detecting means for detecting an abnormal state of the heating means, wherein the heating means includes a plurality of heater element groups each having a plurality of the heater elements, the detecting means includes a plurality of current detecting elements for detecting the abnormal state of the heater element groups respectively.

2. The image heating apparatus according to claim 1, wherein the current detecting element is electrically connected to the heater elements of the heater element group.

3. The image heating apparatus according to claim 1, wherein the detecting means includes temperature detecting elements provided in correspondence with the heater elements, and the current detecting element is provided in each of temperature detecting element groups each having a plurality of temperature detecting elements.

4. The image heating apparatus according to claim 1, wherein when the abnormal state is detected in at least one of the heater element groups by the detecting means, energization to the heating means is stopped.

5. The image heating apparatus according to claim 1, further comprising a controller which sends a signal for informing that the apparatus has abnormality when the abnormal state is detected in at least one of the heater element groups by the detecting means.

6. The image heating apparatus according to claim 5, wherein the controller invalidates a signal which is received from the detecting means within a set time after energization to the heating means is started.

* * * * *